United States Patent [19]

Mihalisin et al.

[11] Patent Number: 4,994,236

[45] Date of Patent: Feb. 19, 1991

[54] METHOD OF MAKING HIGH MELTING POINT ALLOYS

[75] Inventors: John R. Mihalisin, N. Caldwell; Michelle K. Tripucka, Mountain Lakes, both of N.J.

[73] Assignee: Howmet Corporation, Greenwich, Conn.

[21] Appl. No.: 311,412

[22] Filed: Feb. 15, 1989

Related U.S. Application Data

[63] Continuation of Ser. No. 82,579, Aug. 7, 1987, abandoned.

[51] Int. Cl.[5] ..... C22C 1/00

[52] U.S. Cl. ..... 420/590; 420/129

[58] Field of Search ..... 420/129, 590

[56] References Cited

U.S. PATENT DOCUMENTS

| | | | |
|---|---|---|---|
| 1,916,410 | 7/1933 | Brace . | |
| 1,924,244 | 8/1933 | Koster . | |
| 2,150,094 | 3/1939 | Bieber . | |
| 2,163,224 | 6/1939 | Alexander . | |
| 3,287,110 | 11/1966 | Scherbner | 420/446 |
| 3,672,879 | 6/1972 | Buehler . | |
| 4,045,255 | 8/1977 | Jackson | 148/32 |
| 4,080,200 | 3/1978 | Sheridan | 420/590 |
| 4,718,940 | 1/1988 | McPhillips | 75/10.18 |

FOREIGN PATENT DOCUMENTS 1920056 10/1970 Fed. Rep. of Germany ..... 420/590

OTHER PUBLICATIONS

Compilation of Alloys (Table I to IX) from the Metals Handbook, vol. 8, (Metallography, Structures and Phase Diagrams), 1973.

*Primary Examiner*—Peter D. Rosenberg
*Attorney, Agent, or Firm*—Finnegan, Henderson, Farabow, Garrett & Dunner

[57] ABSTRACT

A method of making high melting point alloys. The reactive and non-reactive charge materials are separately refined as initial alloys, generally as an alloy of a base element selected from the iron group of the Periodic Table, such as nickel, and at least one metallic element other than the base element. At least one first initial alloy and at least one second initial alloy are provided. The metallic elements other than the base element in the first initial alloys are relatively non-reactive in the molten state, whereas the metallic elements in the second initial alloys are relatively reactive in the molten state. Amounts of the first and second initial alloys are selected to yield a predetermined composition of the high melting point alloy upon melting. The selected amounts are melted to form a molten mixture having the predetermined composition, and then the molten mixture is solidified.

12 Claims, 7 Drawing Sheets

FIG. 1

EXAMPLE INITIAL ALLOYS FOR MAKING EQUIAX HIGH MELTING POINT ALLOYS

| Ni(wt%) | Co(wt%) | Cr(wt%) | Mo(wt%) | W(wt%) | Other | N(ppm) | O(ppm) |
|---|---|---|---|---|---|---|---|
| 43 | 17 | 32 | 3 | 5 | – | 31 | 10 |
| 35 | 29 | 30 | 6 | – | – | 23 | 11 |
| 56.5 | – | 20 | 3.5 | – | 20 | 30 | 16 |
| 80 | 10 | 10 | – | – | – | 30 | 5 |
| 60 | – | 27 | 9 | – | 4 | 11 | 17 |
| 78.5 | – | 14.4 | 4.8 | – | 2.3 | 4 | 17 |
| 90 | 10 | – | – | – | – | 1 | 5 |

FIG. 2

EXAMPLE INITIAL ALLOYS FOR MAKING SINGLE CRYSTAL HIGH MELTING POINT ALLOYS

| Ni(wt%) | Co(wt%) | Cr(wt%) | Mo(wt%) | W(wt%) | Ta(wt%) | N(ppm) | O(ppm) |
|---|---|---|---|---|---|---|---|
| 66.5 | 5.7 | 10.8 | – | 4.4 | 12.6 | 9 | 31 |
| 41.1 | 10 | 19 | – | 7.7 | 22.2 | 22 | 29 |
| 41.1 | 10 | 19 | – | 7.7 | 22.2 | 8 | 7 |
| 59.2 | – | 8.5 | 18.5 | 6 | 7.8 | 4 | 5 |
| 41.1 | 10 | 19 | – | 7.7 | 22.2 | 5 | 26 |
| 49 | 10 | 19 | – | – | 22 | 4 | 17 |
| 38 | 10 | 20 | – | – | 22 | 4 | 8 |
| 54.4 | 16.5 | 15.1 | – | – | 14 | 8 | 22 |
| 40.7 | 18.5 | 15.5 | 1.3 | 18.5 | 5 | 10 | 5 |
| 33.2 | – | 29 | 4.5 | 17.6 | 15.7 | 22 | 50 |
| 40.5 | 18.4 | 15.5 | 1.3 | 18.5 | 5.8 | 10 | 5 |
| 32.4 | – | 29.8 | 4.5 | 17.6 | 15.7 | 22 | 50 |

FIG. 4

EXAMPLE INITIAL ALLOY FILE

1. BASE 1: 64% Ni-27% Mo-9% Cb.
2. BASE 2: 48% Ni-32% Cr-17% Mo-3% W.
3. BASE 3: 48% Ni-32% Co-17% Mo-3% W.
4. BASE 4: 42% Ni-20% Co-20% W-18% Cr.
5. 75% Ni-25% Ti.
6. 85% Ni-15% Aℓ.
7. 50% Ni-50% W.
8. 90% Co-10% Ni.
9. 60% Ni-40% Mo.
10. 60% V-40% Ni.
11. 60% Ni-40% Ta.
12. 80% Ni-10% Co-10% Cr.
13. 60% Cb-40% Ni.
14. 80% Ni-20% Cr.

FIG. 5

SAMPLE HEAT FORMULATION FOR HA-738 ALLOY
USING INITIAL ALLOYS (500 LB. HEAT SIZE)

| INITIAL ALLOY TYPE (WT%) | WEIGHT (LBS.) | ALLOY AIM COMPOSITION (WT%) |
|---|---|---|
| 75% Ni-25% Ti | 68.0 | C - .09 |
| 85% Ni-15% AL | 116.7 | Co - 8.40 |
| BASE 4 | 11.1 | Cr - 16.00 |
| BASE 2 | 211.2 | M - 1.65 |
| BASE 1 | 21.3 | W - 2.60 |
| 60% Ni-40% Ta | 21.3 | Ti - 3.40 |
| 80% Ni-10% Co-10% Cr | 38.8 | AL - 3.50 |
| 60% Cb-40% Ni | 4.8 | Cb - .75 |
| 80% Ni-20% Cr | 4.0 | Ta - 1.70 |
| C | .2 | B - .01 |
| Zr * | .10 | Zr - .025 |
| Ni-B * | .30 | Mg - .023 |
| Ni-Mg * | 2.3 | Ni - 61.852 |
| TOTAL | 500.00 | 100% |

* ADDED IMMEDIATELY PRIOR TO POURING IN ACCORDANCE WITH CONVENTIONAL PRACTICE.

FIG. 6

SAMPLE HEAT FORMULATION FOR 713C ALLOY
USING INITIAL ALLOYS (500 LB. HEAT SIZE)

| INITIAL ALLOY TYPE (WT%) | WEIGHT (LBS.) | ALLOY AIM COMPOSITION (WT%) |
|---|---|---|
| 75% Ni-25% Ti | 16.6 | C - .11 |
| 85% Ni-15% Aℓ | 203.3 | Cr - 13.6 |
| 60% Ni-40% Mo | 8.4 | Mo - 16.00 |
| BASE I | 212.7 | Ti - .83 |
| 60% Cb-40% Ni | 4.2 | Aℓ - 6.1 |
| 80% Ni-20% Cr | 52.8 | Cb - 2.2 |
| C | .4 | B - .01 |
| Zr * | .3 | Zr - .06 |
| Ni-B * | .3 | Mg - .01 |
| Ni-Mg * | 1.0 | Ni - 72.584 |
| TOTAL | 500.00 | 100% |

* ADDED IMMEDIATELY PRIOR TO POURING IN ACCORDANCE WITH CONVENTIONAL PRACTICE.

FIG. 7

SAMPLE HEAT FORMULATION FOR MAR-M-200+Hf
USING INITIAL ALLOYS (500 LBS. HEAT SIZE)

| INITIAL ALLOY TYPE | WEIGHT (LBS.) | ALLOY AIM COMPOSITION (%) |
|---|---|---|
| 75% Ni-25% Ti | 39.6 | C - .135 |
| 85% Ni 25% Aℓ | 166.7 | Co - 9.50 |
| BASE 4 | 217.2 | Cr - 8.50 |
| 50% Ni-50% W | 23.4 | W - 11.90 |
| 90% Co-10% Ci | .7 | Ti - 1.98 |
| 80% Ni-10% Co-10% Cr | 34.0 | Aℓ - 5.00 |
| 60% Cb-40% Ni | 7.9 | Cb - .95 |
| C | .4 | B - .016 |
| Ni-B * | .4 | Zr - .025 |
| Hf | 10.0 | Hf - 1.90 |
| | | N - 60.093 |
| TOTAL | 500.00 | 100% |

* ADDED IMMEDIATELY PRIOR TO POURING IN ACCORDANCE WITH CONVENTIONAL PRACTICE.

METHOD OF MAKING HIGH MELTING POINT ALLOYS

This application is a continuation of application Ser. No. 082,579, filed Aug. 7, 1987, now abandoned.

FIELD OF THE INVENTION

The present invention relates to a method of making high melting point alloys through melting.

BACKGROUND OF THE INVENTION

The conventional process for formulating high melting point alloys from constituent materials through melting involves two stages. In the first stage, the non-reactive elements comprising a portion of the high melting point alloy are refined to remove as much oxygen and nitrogen as possible, usually through the addition of carbon to promote a carbon boil.

In the second stage, the elements which readily react with oxygen and nitrogen and comprise the reactive portion of the high melting point alloy are added to the non-reactive charge. The reactive elements are added late in the vacuum induction melt cycle so that the time these elements spend in the vacuum furnace is minimized to limit any reaction with the crucible lining and residual air in the furnace The reactive elements, however, must remain in the melt for a time sufficient to achieve homogenization. The reactive elements are added, for the most part, as elemental additions rather than mixtures or compounds of several reactive elements. Because allowances must be made to compensate for the wide variety in melting points and densities among the elemental additions, the conventional process for producing high melting point alloys is both time consuming and difficult to automate.

The conventional process suffers from the further disadvantage that exothermic reactions occur when particular reactive elements are added to the melt. For example, an exothermic reaction occurs when aluminum is added to a melt containing nickel. Such exothermic reactions cause high temperature excursions which accelerate the reaction of the melt with the refractory lining of the crucible, resulting in both shortened crucible life and also increased contamination in the high melting point alloy.

Accordingly, it is an object of the invention to provide a method of forming a high melting point alloy which overcomes the difficulties and disadvantages of the prior art.

Additional objects and advantages will be set forth in part in the description which follows, and in part, will be obvious from the description, or may be learned by practice of the invention.

SUMMARY OF THE INVENTION

To achieve the foregoing objects and in accordance with the purpose of the invention, as embodied and broadly described herein, there is provided a method of making a high melting point alloy. In this method the high melting point alloy is comprised of a combination of a base element selected from the iron group of the Periodic Table and a plurality of metallic elements other than the base element. At least one first initial alloy is provided. The first initial alloy consists essentially of the base element and at least one of the metallic elements. The metallic elements other than the base element in the first initial alloys are relatively non-reactive in the molten state. At least one second intial alloy is provided. The second initial alloy consists essentially of the base element and at least one of the metallic elements. The metallic elements in the second initial alloys are relatively reactive in the molten state. Amounts of the first and second initial alloys are selected to yield a predetermined composition of the high melting point alloy upon melting. The selected amounts of the first and second initial alloys are melted to form a molten mixture having the predetermined composition. The molten mixture is then solidified.

BRIEF DESCRIPTION OF THE DRAWINGS

FIG. 1 is a table of example initial alloys for making equiax high melting point alloys according to the method of the invention.

FIG. 2 is a table of example initial alloys for making single crystal melting point alloys according to the method of the invention.

FIG. 4 is a table of an example initial alloy file for making high melting point alloys according to the method of the invention.

FIG. 5 is a table of a sample heat formulation for making HA-738 alloy using the initial alloys listed in FIG. 4.

FIG. 6 is a table of a sample heat formulation for making 713C alloy using the initial alloys listed in FIG. 4.

FIG. 7 is a table of a sample heat formulation for making MAR-M-200+Hf alloy using the initial alloys listed in FIG. 4

Figure 3:
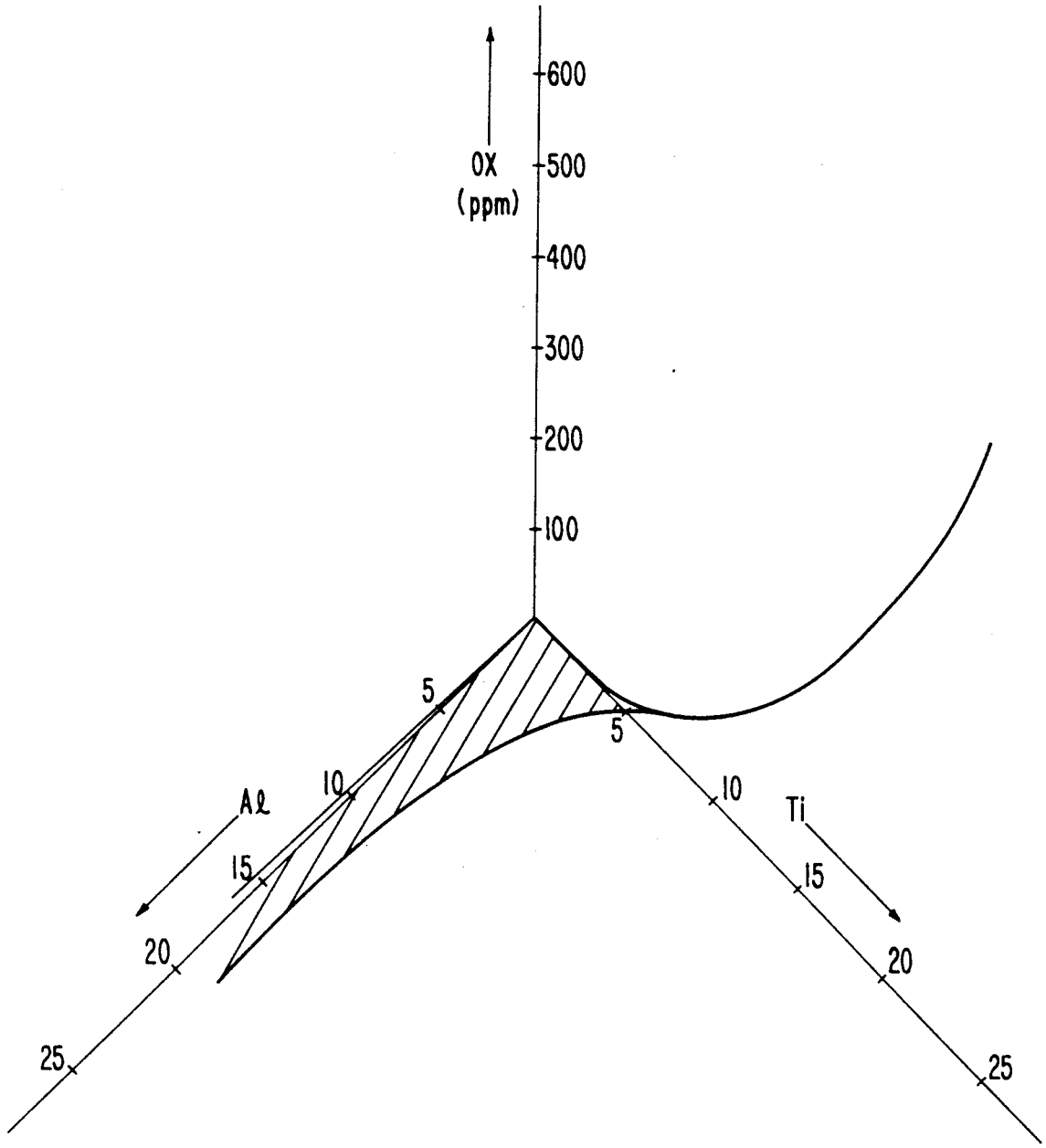
FIG. 3 is a three-dimensional graph showing the relationship between oxygen level and aluminum and titanium content in Ni-Ti-Al alloys.

The accompanying drawings, which are incorporated in and constitute a part of this specification, illustrate several exemplary embodiments of the invention and together with the description, serve to explain the principles of the invention.

DESCRIPTION OF THE PREFERRED EMBODIMENTS

Reference will now be made in detail to the present preferred embodiments of the invention.

The method of making a high melting point alloy of the present invention involves separately pre-refining the reactive and non-reactive charge materials as initial alloys, generally as an alloy of a base element selected from the iron group of the Periodic Table, such as nickel, and at least one metallic element other than the base element. While the invention is disclosed using embodiments containing Ni as the base metal, Co, Fe, and Cr-based alloys are also operable. To form desired high melting point alloy compositions, amounts of the initial alloys are selected to yield the desired composition. These amounts are charged in a suitable means for melting, such as a vacuum induction furnace, and melted. Because the initial alloys have already been refined, no further refining steps are necessary. In addition, because the melting point and density disparities encountered with elemental additions are significantly less with the initial alloys, the charge comprised of such initial alloys can be melted rapidly and homogenization can be achieved in a relatively short period of time.

In accordance with the invention, there is provided at least one first initial alloy, the first initial alloy consisting essentially of the base element and at least one of the metallic elements, the metallic elements other than the base element in the the first initial alloys being relatively non reactive in the molten state. Examples of non-reactive elements include Ni, Cr, Mo, W, V, Fe, Co, and Re.

To eliminate the need for refining the melt of the desired high melting point alloy composition, and to allow the melt to be formed by vacuum induction melting, the first initial alloy or alloys provided should be refined to low levels of oxygen and nitrogen. Thus, suitable first initial alloys for carrying out the method of the invention are compositions which can be formed with sufficiently low oxygen and nitrogen levels. In the following discussion, factors involved in formulating suitable first initial alloys when the base element is nickel will be described.

In formulating binary Ni-Cr alloys, because commercially available chromium is generally high in oxygen and nitrogen, the greater the amount of chromium, the greater the amount of oxygen that will be contained in the Ni-Cr alloy. Oxygen can be removed from such alloys in vacuum by dissociation of the oxides, however, the primary means for removing oxygen is by carbon deoxidation. By adding relatively small amounts of carbon (on the order of 0.01% to 0.03%), a carbon boil can be sustained and oxygen is removed as CO gas. It has been found that the oxygen content can be kept to levels below 40 ppm for Ni-Cr alloys containing up to about 40% chromium through carbon deoxidation, and this level is acceptable in Ni-Cr initial alloys. Such oxygen levels can be reduced by subsequent remelting and aluminum deoxidation to below 10 ppm in the final high melting point alloy product.

It has been found that the level of nitrogen in Ni-Cr alloys can be maintained at about 20 ppm to levels up to about 30% chromium. No mechanism such as carbon deoxidation operates to remove nitrogen from Ni Cr alloys, although, some dissociation occurs in vacuum resulting in nitrogen removal. Because nitrogen is removed by vaporization in accordance with Sievert's Law during melting to make the final high melting point alloy product, nitrogen levels less than 50 ppm are acceptable in Ni Cr initial alloys.

For elements similar to Ni, such as Co, it has been found that low gas levels can be obtained at high concentrations of the alloying elements. For example, a 90% Ni-10% Co alloy was found to contain only 1 ppm of nitrogen and 5 ppm of oxygen.

In preparing initial alloys with strong carbide forming elements such as tantalum, columbium, and vanadium, important effects have been observed. For example, a binary 34% Ni-66% Ta initial alloy was formulated with elemental tantalum containing about 2200 ppm of oxygen, 100 ppm of nitrogen, and 600 ppm of carbon. Excess carbon was added during melting and the resultant 34% Ni-66% Ta initial alloy contained 357 ppm of oxygen, 16 ppm of nitrogen, and 300 ppm of carbon. It has been found that the oxygen content in Ni-Ta alloys can be reduced without adding excess carbon by reducing the tantalum content of the alloy. For example, a binary 60% Ni-40% Ta alloy was found to contain only 15 ppm of oxygen, 4 ppm of nitrogen, and 300 ppm of carbon. It is believed that the decrease in the oxygen content is attributable to the inhibiting effect of tantalum on the carbon boil. At a level of approximately 40%, tantalum apparently does not inihibit the carbon boil.

The reduction of the oxygen content in Ni-Ta initial alloys without adding excess carbon is important because the carbon levels in the initial alloys must be low enough to meet the specifications of the final high melting point alloy product. For single crystal high melting point alloys, the level of carbon specified is often less than 100 ppm.

The oxygen content in both Ni-Cb and Ni-V alloys can be reduced in a similar manner as described above for Ni-Ta alloys. Ni-V alloys have a high affinity for oxygen, however, and, consequently, the oxygen content can not be lowered in Ni-V alloys to the same extent it can be lowered in Ni-Ta and Ni-Cb alloys. For example, a 40% Ni-60% V alloy was formulated and found to contain 2900 ppm of oxygen and 300 ppm of nitrogen. By reducing the vanadium content to 42%, along with the addition of 0.12% carbon, the oxygen and nitrogen contents in the resultant 58% Ni-42% V alloy were lowered to 495 ppm and 223 ppm, respectively.

For elements that form less stable carbides, such as Mo, it has been found that low gas levels can readily be obtained in binary alloys. For example, a 53% Ni-47% Mo alloy was formulated and found to contain 10 ppm of oxygen and 3 ppm of nitrogen. In addition, a 47% Ni-53% Mo alloy was formulated and found to contain 18 ppm and 4 ppm of oxygen and nitrogen, respectively.

Conventional commercial high melting point alloys generally contain on the order of 12 elements. In formulating such alloys according to the method of the present invention, it is desirable to use initial alloys containing more than two elements. Examples of suitable initial alloys containing more than two elements are shown in FIGS. 1 and 2. FIG. 1 is a table of suitable initial alloys containing three to five elements for formulating equiax high melting point alloys. FIG. 2 is a table listing suitable initial alloys containing as many as six elements for formulating complex single crystal high melting point alloys. The oxygen and nitrogen levels for each of the initial alloys in FIGS. 1 and 2 fall within the permissible gas levels described above for practice of the invention.

In accordance with the invention, there is provided at least one second initial alloy, the second initial alloy consisting essentially of the base element and at least one of the metallic elements, the metallic elements in the second initial alloys being relatively reactive in the molten state. Examples of reactive elements include Ti, Al, Zr, Hf, Y, B, and rare earth elements.

Due to their tendency to react with their surroundings, reactive elements present special problems when they are melted, and these problems must be taken into consideration in providing the second initial alloys for carrying out the method of the invention. Factors involves in formulating suitable second initial alloys when the base element is nickel will be described in the following discussion.

Because reactive elements such as Ti, Al, Hf, etc. react readily with oxygen and nitrogen, vacuum melting procedures are generally employed. Nontheless, due to the use of refractory crucibles, contamination may be introduced into the melt, and the possibility of such contamination restricts the amounts of reactive elements which may be included in the second initial alloys. On the other hand, it is most cost effective to formulate second initial alloys containing as large an amount of the reactive elements as possible to avoid a surplus of the base element. A surplus of the base element restricts the amount of initial alloys that can be used in making a high melting point alloy melt. It has been found that restricting the oxygen and nitrogen levels in the second initial alloys to approximately 20 ppm each suitably balances the aforesaid opposing factors for carrying out the method of the invention.

For acceptable cleanliness and efficient alloying, it has been found that a combination of vacuum induction melting and electron beam refining is preferred for formulating the second initial alloys. Unless otherwise stated, the second initial alloys set forth in the description which follows were formulated through a combination of vacuum induction melting and electron beam refining.

Several Ni-Al initial alloys were formulated and it was found that acceptable oxygen and nitrogen levels can be readily obtained. Examples of the Ni-Al alloys formulated, and the gas levels obtained, are listed below:

| Ni (wt %) | Al (wt %) | O (ppm) | N (ppm) | C (wt %) |
|---|---|---|---|---|
| 85 | 15 | 2 | 2 | 20 ppm |
| 85 | 15 | 5 | 3 | .04 |
| 88 | 12 | 4 | 4 | 50 ppm |
| 90 | 10 | 4 | 4 | .01 |
| 95 | 5 | 3 | 4 | .02. |

From the examples listed above, it can be seen that both the oxygen and nitrogen levels in Ni-Al alloys are quite low. Further, the amount of carbon present appears to have little effect on the oxygen level, however, this may be due to the low level of oxygen present.

Several Ni Ti initial alloys were formulated and it was found that the oxygen level in these alloys is high. Examples of the Ni-Ti alloys formulated, and the gas levels obtained, are listed below:

| Ni (wt %) | Ti (wt %) | O (ppm) | N (ppm) | C (wt %) |
|---|---|---|---|---|
| 75 | 25 | 600 | 8 | .01 |
| 85 | 20 | 240 | 4 | 10 ppm |
| 90 | 10 | 82 | 7 | 30 ppm |
| 95 | 5 | 25 | 4 | 30 ppm. |

From the above examples, it can be seen that, due to the reactivity of titanium, the oxygen levels in Ni-Ti alloys are higher than for Ni-Al alloys. Because titanium has a strong affinity for carbon, a carbon boil is not effective in reducing the oxygen level in Ni-Ti alloys. Thus, for purposes of carrying out the method of the invention, only up to about 10% titanium may be included in Ni-Ti alloys. However, because the majority of cast high melting point alloys contain relatively low amounts of titanium, restricting titanium to about 10% in the second initial alloys does not significantly limit the amount of initial alloys that can be used to make most high melting point alloy melts.

As a result of attempts to reduce the gas levels in titanium bearing initial alloys, it has been found that reduced gas levels can be obtained by formulating ternary Ni-Al-Ti alloys. By way of example, a number of 86.6% Ni-10.6% Al-2.8% Ti alloys were formulated, and the gas levels obtained are listed below:

| Alloy No. | O (ppm) | N (ppm) | C (wt %) |
|---|---|---|---|
| 1 | 18 | 4 | .01 |
| 2 | 20 | 4 | .01 |
| 3 | 5 | 4 | .01 |
| 4 | 10 | 4 | .01 |

In addition, a 77.2% Ni-11% Co-6.5% Al 5.3% Ti alloy was formulated and found to contain 7 ppm of oxygen, 4 ppm of nitrogen, and less than 10 ppm of carbon.

FIG. 3 is a three-dimensional graph showing the relationship between oxygen level and aluminum and titanium content in Ni-Al-Ti initial alloys. It appears that acceptable oxygen levels extend along the aluminum axis up to the range from about 5% to about 10% titanium. Thus, it is believed that the following alloys would be suitable second initial alloys for carrying out the method of the invention:

| Ni (wt %) | Al (wt %) | Ti (wt %) |
|---|---|---|
| 20 | 80 | 0 |
| 40 | 60 | 0 |
| 15 | 76 | 5 |
| 38 | 57 | 5 |
| 17.3 | 72.7 | 10 |
| 35.5 | 54.5 | 10. |

In accordance with the invention, amounts of the first and second initial alloys are selected that will yield a predetermined composition of the high melting point alloy upon melting. Examples of both the initial alloys and the amounts of such alloys which could be used to make particular high melting point alloys are shown in FIGS. 4–7. FIG. 4 is a table listing an example file of initial alloys which may be used in carrying out the method of the invention. FIGS. 5–7 are tables showing sample heat formulations for making various high melting point alloys using the example initial alloys shown in FIG. 4. FIG. 5 shows a sample heat formulation for making HA-738 alloy. In FIG. 6, a sample heat formulation for making 713C alloy is provided. A sample heat formulation for making MAR-M-200+Hf alloy is listed in FIG. 7.

In accordance with the invention, the selected amounts of the first and second initial alloys are melted to form a molten mixture having the predetermined composition of the high melting point alloy. The first and second initial alloys may be charged in a vacuum induction furnace and simultaneously melted without any further refining steps. Because the first and second initial alloys have comparable melting points and the density disparities are much less than with elemental additions, the charge can be melted rapidly and homogenization is achieved in a relatively short period of time.

In accordance with the invention, the molten mixture having the predetermined composition is solidified to form the final high melting point alloy product. Those skilled in the art are familiar with suitable techniques for solidifying such molten mixtures.

The principles of the present invention described broadly above will now be described with reference to a specific example. A production size lot (5,000 lbs.) of a single crystal high melting point alloy was made according to the method of the invention. The specifications for the composition of the single crystal high melting point alloy that was formulated are as follows:

Ta 11.75/12.25 wt. %;
Cr 9.50/10.50 wt. %;
Al 4.75/ 5.25 wt. %;
Co: 4.50/ 5.50 wt. %;
W: 3.75/ 4.25 wt. %;
Ti: 1.25/1.75 wt. %;
C: 50 ppm maximum;
Ni: balance To make the above high melting point alloy, a first initial alloy comprised of the base element nickel and other non-reactive elements was formulated. The composition of the first initial alloy was as follows:

| Ni (wt %) | Cr (wt %) | W (wt %) | Ta (wt %) | N (ppm) | O (ppm) | C (wt %) |
|---|---|---|---|---|---|---|
| 39.30 | 19.70 | 7.80 | 22.90 | 8 | 91 | .001. |

Because the specification of the desired high melting point alloy requires less than 50 ppm of carbon, carbon additions could not be made to reduce the level of oxygen in the first initial alloy. Thus, the oxygen level of this alloy is above that normally acceptable for first initial alloys, however, this alloy may still be used in the method of the invention. The addition of about 0.02% to about 0.03% carbon could easily lower the oxygen level to less than 20 ppm.

A second initial alloy comprised of the base element nickel and other reactive elements was formulated. The composition of the second initial alloy was as follows:

| Ni (wt %) | Al (wt %) | Ti (wt %) | N (ppm) | O (ppm) | C (wt %) |
|---|---|---|---|---|---|
| 86.9 | 10.3 | 2.8 | 4 | 24 | .001. |

Subsequently, it was determined that 51.9% of the first initially alloy and 48.1% of the second initial alloy was required to yield a melt having the desired high melting point alloy composition. Accordingly, these selected amounts of the first and second initial alloys were melted together in a vacuum induction furnace, and the following composition resulted Ta: 12.05 wt. %;
Cr: 10.15 wt. %;
Al: 4.97 wt. %;
Co: 5.35 wt. %;
W: 4.00 wt. %;
Ti: 1.35 wt. %;
C: 10 ppm;
O: 3 ppm;
N: 5 ppm;
Ni: balance.

The resulting composition was within the specifications for the final high melting point alloy product and, therefore, no additional adjustments were required to reach the desired composition. Furthermore, the levels of oxygen and nitrogen contained in the alloy were relatively low.

In making the high melting point alloy described in the above examples, both the first and second initial alloys were separately filtered in the molten state in accordance with ultra clean high melting point alloy casting practice. In addition, the molten mixture of the first and second initial alloys was filtered after these alloys were melted together. Thus, the resultant high melting point alloy was, in effect, double filtered.

It will be apparent to those skilled in the art that various modifications and variations can be made in the method of making a high melting point alloy of the present invention without departing from the scope or spirit of the invention. Although the present invention has been disclosed in terms of preferred embodiments, the invention is not limited thereto, and its scope is to be defined by the appended claims and their equivalents.

What is claimed is:

1. A method of making a high melting point alloy having an overall desired composition, said high melting point alloy being comprised of a combination of a base element selected from the iron group of the Periodic Table and a plurality of metallic elements other than said base element, said method comprising the steps of:

providing at least one first initial alloy, said first initial alloy consisting essentially of said base element and at least one of said metallic elements, said metallic elements other than said base element in said first initial alloys being relatively non-reactive with oxygen and nitrogen in the molten state;

providing at least one second initial alloy, said second initial alloy consisting essentially of said base element and at least one of said metallic elements, said metallic elements in said second initial alloys being relatively reactive with oxygen and nitrogen in the molten state;

selecting amounts of said first and second initial alloys that will yield said overall desired composition of said high melting point alloy upon melting;

melting said selected amounts of said first and second initial alloys to form a molten mixture having said overall desired composition; and solidifying said mixture.

2. The method of claim 1, wherein said base element is nickel.

3. The method of claim 2, wherein one of said second initial alloys is a Ni-Ta alloy, and the amount of tantalum is limited to reduce the oxygen content of said alloy.

4. The method of claim 3, wherein the amount of tantalum contained in said alloy is below about 40 wt. %.

5. The method of claim 2, wherein one of said second intial alloys is a Ni-V alloy, and the amount of vanadium is limited to reduce the oxygen content of said alloy.

6. The method of claim 5, wherein the amount of vanadium contained in said alloy is approximately 40 wt. %.

7. The method of claim 2, wherein the levels of oxygen and nitrogen contained in said second initial alloys are each approximately 20 ppm.

8. The method of claim 2, wherein one of said second initial alloys is a Ni-Al-Ti alloy.

9. The method of claim 8, wherein said Ni-Al-Ti alloy is selected from the group consisting of 15 wt. % Ni 76 wt. % Al-5 wt. % Ti, 38 wt. % Ni-57 wt. % Al-5 wt. % Ti,17.3 wt. % Ni-72.7 wt. % Al-10 wt. % Ti, and 35.5 wt. % Ni-54-5 wt. % Al-10 wt. % Ti.

10. A method of making a high melting point alloy having an overall desired composition, said high melting point alloy being comprised of a combination of a base element selected from the group consisting of iron and nickel and a plurality of metallic elements other than said base element, said method comprising the steps of:

providing at least one first initial alloy, said first initial alloy consisting essentially of said base element and at least one of said metallic elements, said metallic elements other than said base element in said first initial alloys being relatively non-reactive with oxygen and nitrogen in the molten state;

providing at least one second initial alloy, said second initial alloy consisting essentially of said base element and at least one of said metallic elements, said metallic elements in said second initial alloys being relatively reactive with oxygen and nitrogen in the molten state;

selecting amounts of said first and second initial alloys that will yield said overall desired composition of said high melting point alloy upon melting;

melting said selected amounts of said first and second initial alloys to form a molten mixture having said overall desired composition; and solidifying said mixture.

11. The method of claim 2, wherein one of said second initial alloys is a Ni-Cb alloy, and the amount of columbium is limited to reduce the oxygen content of said alloy.

12. The method of claim 11, wherein the amount of columbium contained in said alloy is below about 60 wt. %.

* * * * *